US007001476B2

(12) United States Patent
Flynn et al.

(10) Patent No.: US 7,001,476 B2
(45) Date of Patent: Feb. 21, 2006

(54) APPARATUS AND METHOD FOR TRANSFERRING A LABEL PORTION FROM A LABEL ASSEMBLY ONTO AN OBJECT

(76) Inventors: Timothy J. Flynn, 18 Caloosa Rd., Key Largo, FL (US) 33037; Thomas E. Flynn, 7305 Gleneagle Cir., Crystal Lake, IL (US) 60014; Patrick J. Flynn, 107 Jennifer St., Redlands, CA (US) 92373

( * ) Notice: Subject to any disclaimer, the term of this patent is extended or adjusted under 35 U.S.C. 154(b) by 85 days.

(21) Appl. No.: 10/771,180

(22) Filed: Feb. 3, 2004

(65) Prior Publication Data

US 2005/0178497 A1 Aug. 18, 2005

(51) Int. Cl.
*B65C 1/00* (2006.01)
*B65C 1/02* (2006.01)
*B65C 9/26* (2006.01)

(52) U.S. Cl. ..... 156/247; 156/230; 156/391; 156/DIG. 1; 156/DIG. 2; 156/DIG. 37

(58) Field of Classification Search ..... 156/247, 156/230, 391, 580, DIG. 1, DIG. 2, DIG. 37; 428/40.1, 41.1, 42.1, 42.2
See application file for complete search history.

(56) References Cited

U.S. PATENT DOCUMENTS

| | | | | |
|---|---|---|---|---|
| 465,588 | A | 12/1891 | Wheeler | |
| 1,500,698 | A | 7/1924 | Wiehl | |
| 1,821,916 | A | 9/1931 | Acheson | |
| 4,084,015 | A | 4/1978 | Patterson | |
| 5,334,432 | A | 8/1994 | Long | |
| 5,662,976 | A | 9/1997 | Popat et al. | |
| 5,715,934 | A | 2/1998 | Tobol et al. | |
| 5,770,289 | A | 6/1998 | Tracy | |
| 5,925,200 | A | 7/1999 | Grossman | |
| 6,047,991 | A | 4/2000 | Finke et al. | |
| 6,054,009 | A | 4/2000 | Cote et al. | |
| 6,196,290 | B1 | 3/2001 | Tracy et al. | |
| 6,273,167 | B1 | 8/2001 | Miller | |
| 6,302,176 | B1 | 10/2001 | Chen | |
| 6,318,436 | B1 | 11/2001 | Hummell et al. | |
| 6,321,811 | B1 | 11/2001 | Atkinson et al. | |
| 6,321,814 | B1 * | 11/2001 | Tracy et al. | 156/556 |
| 6,347,654 | B1 | 2/2002 | Koch | |
| 6,363,987 | B1 | 4/2002 | Koch | |
| 6,403,191 | B1 | 6/2002 | Casagrande | |
| 6,405,777 | B1 | 6/2002 | Lebbad | |
| 6,408,918 | B1 | 6/2002 | Hummell et al. | |
| 6,431,238 | B1 | 8/2002 | Atkinson | |

(Continued)

FOREIGN PATENT DOCUMENTS

DE 298 00 751 U1 7/1998

(Continued)

*Primary Examiner*—Sue A. Purvis
(74) *Attorney, Agent, or Firm*—Pauley Petersen & Erickson

(57) ABSTRACT

A method for transferring a label portion from a label assembly onto an object includes sliding the label assembly between a base and an elevated support connected with respect to the base. The label portion is positioned within an application area defined on a surface of the base with an adhesive side of the label portion exposed. An object, such as a compact disc, is released within a chute formed by the support and elevated over the application area. The object contacts the adhesive side of the label portion to apply the label portion to the object. The object is then removed from the apparatus and the label portion is transferred from the label assembly onto the object.

24 Claims, 5 Drawing Sheets

U.S. PATENT DOCUMENTS

| | | | | |
|---|---|---|---|---|
| 6,450,229 | B1 | 9/2002 | Koch | |
| 6,453,243 | B1 * | 9/2002 | Watanabe et al. | 702/19 |
| 6,481,484 | B1 | 11/2002 | Isshiki | |
| 6,481,572 | B1 | 11/2002 | Wien et al. | |
| 6,508,914 | B1 | 1/2003 | Schwaller et al. | |
| 6,514,588 | B1 | 2/2003 | Rosenbaum et al. | |
| 6,516,852 | B1 * | 2/2003 | Sandor | 156/391 |
| 6,543,508 | B1 * | 4/2003 | Koch | 156/391 |
| 6,640,862 | B1 * | 11/2003 | Lee et al. | 156/391 |
| 6,689,238 | B1 | 2/2004 | Barnet | |
| 6,717,900 | B1 * | 4/2004 | Weng | 369/72 |
| 6,748,994 | B1 * | 6/2004 | Wien et al. | 156/391 |
| 6,776,208 | B1 | 8/2004 | Flynn et al. | |
| 6,776,866 | B1 | 8/2004 | Flynn et al. | |
| 6,776,867 | B1 | 8/2004 | Flynn et al. | |
| 2001/0025689 | A1 | 10/2001 | Barnet | |
| 2005/0103433 | A1 * | 5/2005 | Flynn et al. | 156/247 |

FOREIGN PATENT DOCUMENTS

| | | | | |
|---|---|---|---|---|
| DE | 10015601 | A1 | * | 10/2001 |
| EP | 1 264 772 | A2 | | 12/2002 |
| GB | 2351273 | A | * | 12/2000 |
| JP | 2000326944 | A | * | 11/2000 |
| JP | 2001101827 | A | * | 4/2001 |
| WO | WO 01/28866 | A1 | | 4/2001 |

* cited by examiner

APPARATUS AND METHOD FOR TRANSFERRING A LABEL PORTION FROM A LABEL ASSEMBLY ONTO AN OBJECT

BACKGROUND OF THE INVENTION

This invention is directed to an apparatus and method for applying and transferring a label portion from a label assembly onto an object, such as a compact disc or a digital video disc.

DESCRIPTION OF RELATED ART

Labels such as those described herein can be used in connection with a wide variety of items, particularly, compact discs (CDs), digital video discs (DVDs), jewel cases and the like. It is desirable to have a label for adhering to items that will apply straight and direct to the object without misalignment, wrinkles, bubbles, folds or other errors inherent in the application of adhesive-backed labels onto items.

In addition, labels improperly affixed to objects, such as CDs, with adhesive can harm the discs if a user attempts to remove and/or straighten the labels. More specifically, damage may be caused by pulling off some of the disc protective coating, metal and dye along with the label. In addition, when a traditional label is peeled from its backing, the traditional label includes an inherent curling that may manifest itself a period of time later by peeling away from the object. This peel memory is problematic with tradition peel and stick labels and particularly destructive when used in connection with CDs that require high-speed, balanced rotation for proper operation.

Accordingly, a need exists for a new and improved apparatus and method for applying and transferring a label portion from a label assembly onto an object, such as a CD or a DVD, in an accurate and positive fashion.

SUMMARY OF THE INVENTION

A general object of the invention is to provide an improved apparatus and method for applying and transferring a label portion from a label assembly onto an object, such as a CD or a DVD.

A more specific object of the invention is to overcome one or more of the problems described above.

The above and other objects of the invention can be attained through an apparatus including a base and an application area defined on a surface of the base. An elevated support is connected with respect to the base surface and a chute is mounted on or preferably formed by the support. The chute is suspended over the application area and forms an opening for receiving the object, such as a CD. The label assembly is slidably positionable on the base surface to position the label portion within the application area and align the label portion with the object retained within the chute opening.

The prior art generally fails to provide an apparatus for transferring a label portion from a label assembly onto an object, wherein the label assembly is slidably positionable on the base surface to position the label portion within the application area and align the label portion with an object retained within the support chute suspended over the application area.

The invention further comprehends a method for transferring the label portion from the label assembly onto the object. The label assembly is slidably positioned within a space or gap formed between the base surface and the elevated support connected with respect to the base surface. The label portion is positioned within the application area defined on the base surface with an adhesive side of the label portion exposed. The object is positioned within the chute and suspended over the application area. The object is moved or pushed towards the adhesive side of the label portion to apply the label portion to the object. The object is then removed from the apparatus and the label portion is transferred from the label assembly onto the object.

Other objects and advantages of the invention are apparent to those skilled in the art, in view of the following detailed description taken in conjunction with the appended claims and drawings.

BRIEF DESCRIPTION OF THE DRAWINGS

The present invention can be better understood with reference to the following drawings. In the drawings, like reference numerals designate corresponding parts throughout the several views. Moreover, it should be noted that the drawings are not necessarily to scale, emphasis instead being placed upon clearly illustrating principles of the present invention.

DETAILED DESCRIPTION OF THE INVENTION

Figure 1:
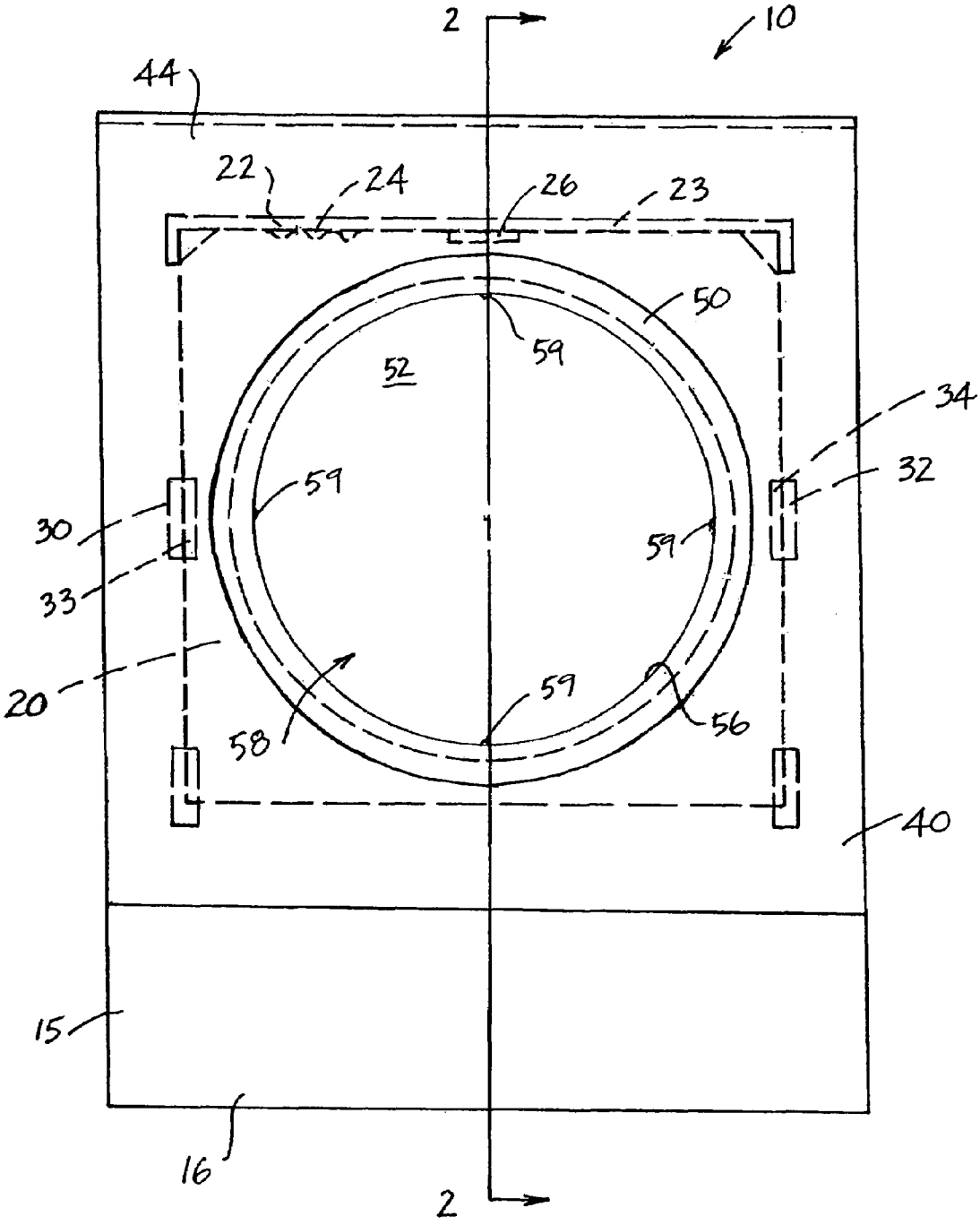
FIG. 1 illustrates a top view of an apparatus for transferring a label portion from a label assembly onto an object, according to one preferred embodiment of this invention.
Figure 2:
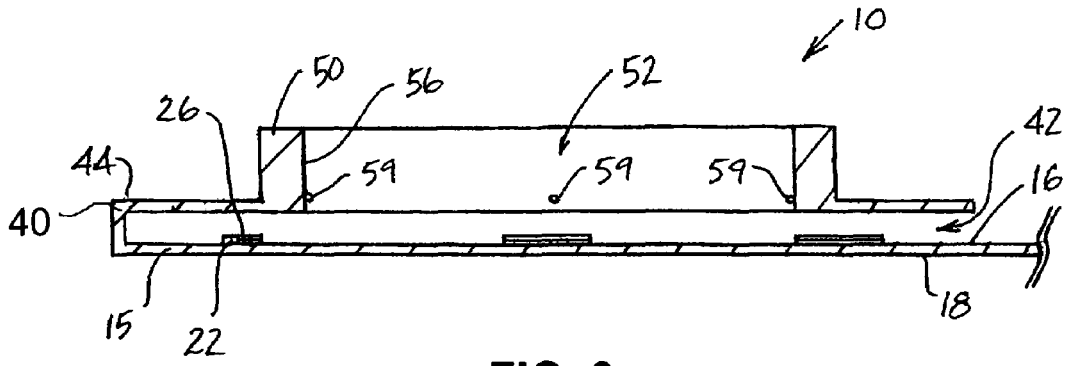
FIG. 2 illustrates a cross-sectional side view of the apparatus for transferring a label portion from a label assembly onto an object shown in FIG. 1, according to one preferred embodiment of this invention.
Figure 3:
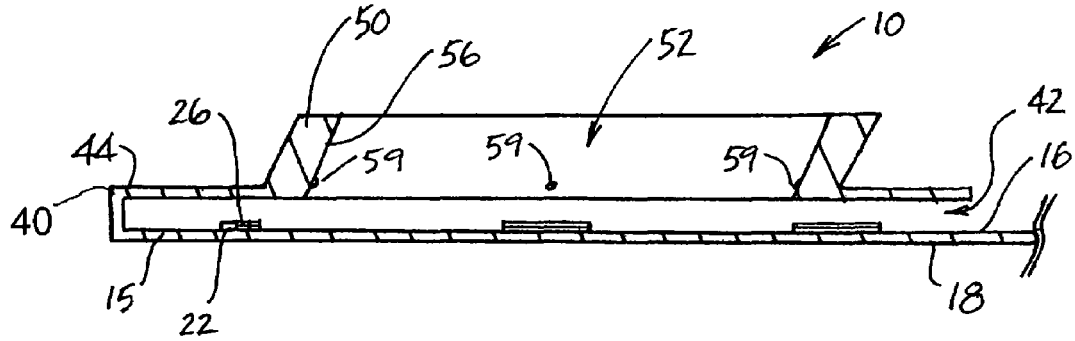
FIG. 3 illustrates a cross-sectional side view of an apparatus for transferring a label portion from a label assembly onto an object, according to one preferred embodiment of this invention.
Figure 4:
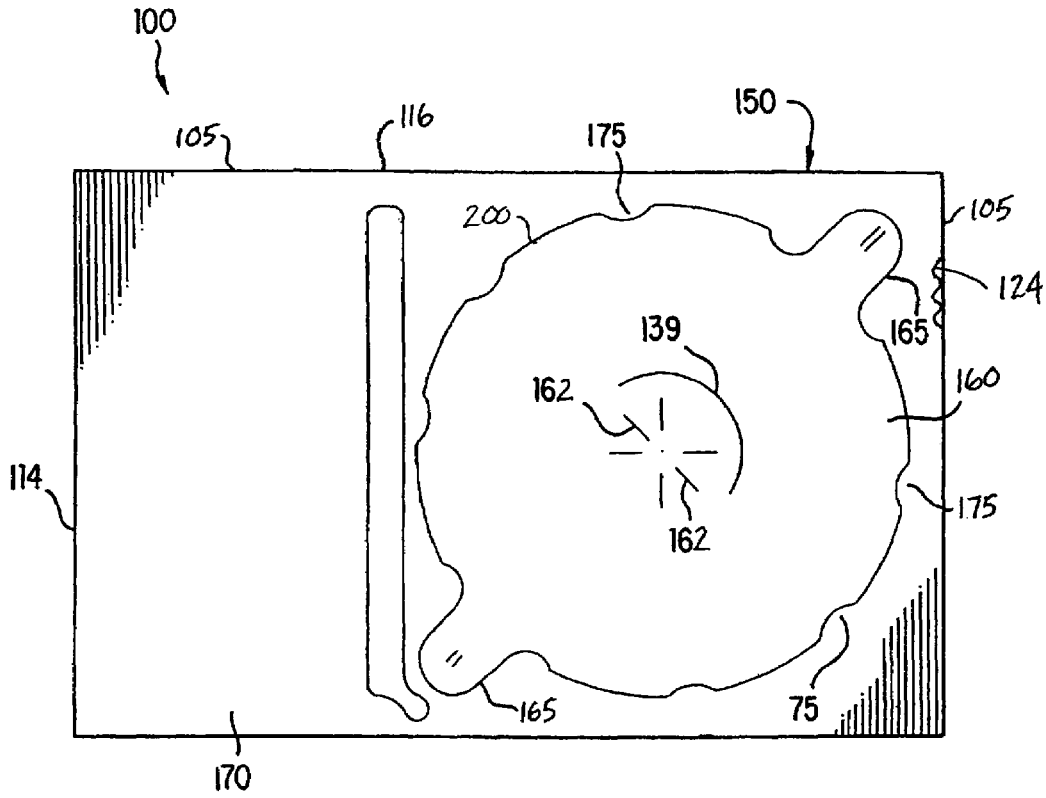
FIG. 4 illustrates a back sheet side view of a label assembly, according to one preferred embodiment of this invention.
Figure 5:
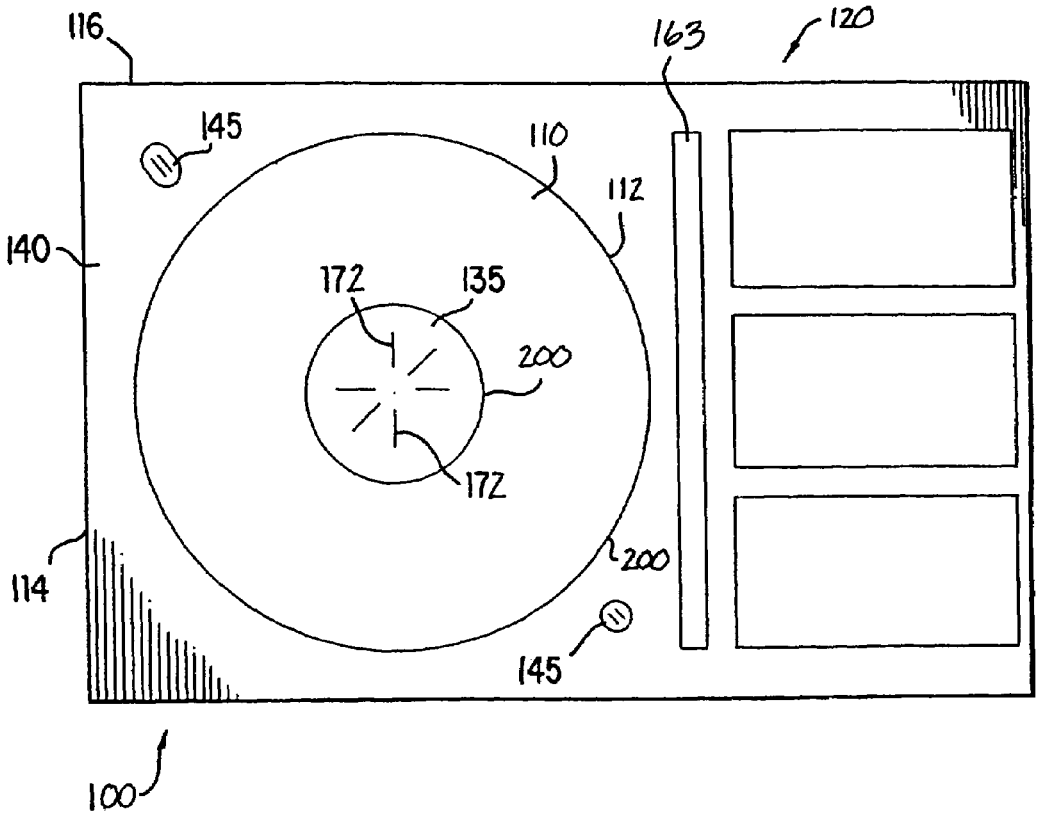
FIG. 5 illustrates a face sheet side view of the label assembly, opposite the view shown in FIG. 4, according to one preferred embodiment of this invention.
Figure 6:
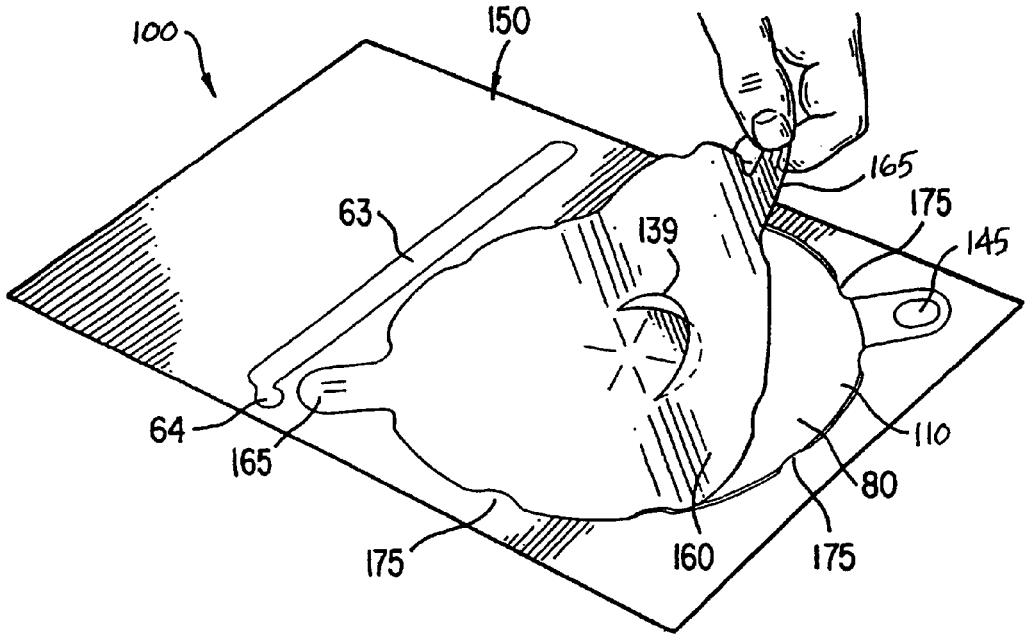
FIG. 6 illustrates a side perspective view of a label assembly as a first portion of a back sheet is removed from a label portion of the label assembly, according to one preferred embodiment of this invention.

FIGS. 1–3 illustrate an apparatus 10 for applying and transferring a label portion, such as label portion 110 from a label assembly 100, as shown in FIGS. 4–6, onto an object, according to preferred embodiments of this invention. Apparatus 10, according to various preferred embodiments of this invention, is particularly suitable for applying and transferring label portion 110 from label assembly 100 to a surface of a CD or a DVD. It is not necessary that apparatus 10 shown in FIGS. 1–3 be used with label assembly 100 shown in FIGS. 4–6 and vice versa; however, apparatus 10 and label assembly 100 may include features that are particularly useful when used together.

In one preferred embodiment of this invention, apparatus 10 comprises a base 15. Referring to FIGS. 2–3, apparatus 10 comprises base 15 having a first surface 16 and an opposing second surface 18. Preferably, base 15 is molded or otherwise formed of a suitable plastic material. Base 15 may comprise any other suitable material known to those skilled in the art, such as metal, wood, a composite material or any strong, durable and generally rigid material.

An application area 20 is formed or defined on a surface of base 15. For example, application area 20 is formed on first surface 16, as shown in FIG. 1. In one preferred embodiment of this invention, application area 20 is bounded at a first end by a stop element 22 connected with respect to first surface 16. Stop element 22 may comprise a continuous wall 23, such as shown in FIG. 1, to limit or interfere with at least a portion of label assembly 100 when label assembly 100 is positioned on first surface 16 and within application area 20, as discussed in further detail below. Preferably, at least a portion of stop element 22 is integrated with base 15. For example, stop element 22 may be integrated or molded with first surface 16 during the apparatus manufacturing process. Stop element 22 may comprise any suitable member or element connected to or integrated with base 15, which preferably extends or projects from first surface 16. For example, stop element 22 may comprise a segmented wall including at least two wall segments or at least one projection formed on first surface 16. As shown in FIG. 1, stop element 22 preferably comprises a lip portion 26, which extends or is suspended over a portion of application area 20 to position and secure label assembly 100 in apparatus 10.

In one preferred embodiment of this invention, stop element 22 comprises an indexing element 24, as shown for example in FIG. 1. Indexing element 24 may comprise any suitable number of projections, notches and/or other profile, design, angle or edge that permits positive engagement between label assembly 100 and apparatus 10. For example, indexing element 124 formed on a periphery 105 of label assembly 100 can engage or interfere with indexing element 24 to position label assembly 100 in an indexed position with respect to application area 20.

Additionally or alternatively, application area 20 can be bounded by at least one guide 30, 32 positioned with respect to application area 20 and corresponding to at least a portion of label assembly periphery 105. Preferably, application area 20 is bounded on lateral sides by opposing guide members 30, 32, as shown in FIG. 1. Guides 30, 32 limit, interfere with and/or guide label assembly 100 as label assembly 100 is slidably positioned on application area 20. In one preferred embodiment of this invention, at least a portion of each opposing guide 30, 32 forms a lip portion 33, 34, respectively, which extends or is suspended over a portion of application area 20, to maintain label assembly 100 in contacting relation with first surface 16 as label assembly 100 is slidably positioned within application area 20. Guides 30, 32 may comprise any suitable member or element known to those skilled in the art connected to or integrated with base 15, which preferably extends or projects over a portion of application area 20 with respect to first surface 16. For example, guides 30, 32 may comprise a continuous wall, similar to stop element 22, or at least one projection formed on first surface 16.

An elevated support 40 is mounted or connected with respect to base 15 and extends or is suspended over at least a portion of first surface 16. In one preferred embodiment of this invention, a first end portion 44 of support 40 is fixedly mounted or connected to base 15 and support 40 extends at an elevated height over first surface 16 and application area 20. The term "elevated" as used throughout this specification and in the claims refers to support 40 being positioned at a generally suspended height with respect to first surface 16 to form or define a space or gap 42 between first surface 16 and support 40. At least a portion of label assembly 100 is slidably movable or slidably positionable within gap 42 to position label portion 110 within application area 20. The terms "slidably movable" and "slidably positionable" refer to the ability of the user to slide or insert label assembly 100 within gap 42 formed between first surface 16 and elevated support 40, without any interference and/or restriction by projections or elements extending from or formed in base surface 16, such as a projection to center a CD within application area 20, as in conventional apparatus. Preferably, gap 42 has a suitable height slightly greater than a thickness of label assembly 100, which allows label assembly 100 to move freely within gap 42 without an exposed adhesive side of label portion 110 contacting and adhering to a bottom surface of support 40 as label assembly 100 is positioned on first surface 16. Further, gap 42 allows the user to pull or remove label assembly 100, with an object such as a CD or a DVD adhesively attached or connected to label portion 110, from within gap 42, as discussed below.

In one preferred embodiment of this invention, a chute 50 is mounted on or connected to support 40 and elevated or suspended over application area 20, as shown in FIGS. 1–3. Preferably, chute 50 forms an opening 52 wherein the object is placed to apply label portion 110 to the object and transfer label portion 110 from label assembly 100 onto the object. For example, as shown in FIGS. 1–3, chute 50 preferably but not necessarily forms a cylinder having a generally circular opening 52, wherein a CD or a DVD can be positioned and/or retained. As shown in FIGS. 1 and 2, in one preferred embodiment of this invention, chute 50 is mounted or formed in support 40 generally perpendicular to application area 20. In an alternate preferred embodiment of this invention, chute 50 is positioned at an acute angle with respect to application area 20, as shown for example in FIG. 3. Support 40 may have any suitable shape and/or dimensions that provide for alignment of chute 50 with respect to application area 20 so that when label portion 110 is properly positioned within application area 20, label portion 110 is aligned with the object, such as a CD, positioned within chute 50.

In one preferred embodiment of this invention, chute 50 forms or defines a guide area 58. For example, inner surface 56 may form guide area 58 having a generally circular shape, triangular shape or rectangular shape, depending upon the shape of the object onto which label portion 110 will be applied and transferred. Further, inner surface 56 may form guide area 58 having a symmetric shape or an asymmetric shape.

In one preferred embodiment of this invention, a plurality of projections 59 extend or project from inner surface 56 of chute 50. Referring to FIGS. 2, 3 and 5, each projection 59 extends from inner surface 56 a suitable length so that each projection 59 generally extends to and/or terminates at a periphery 112 of label portion 110, positioned within application area 20. Preferably but not necessarily, projections 59 are equally spaced about inner surface 56. For example, as shown in FIG. 1, four projections 59 are equally spaced about inner surface 56 to sufficiently support an object, such as a CD, positioned within chute 50. Projections 59 extend into opening 52 a length that allows the object to be pushed or moved past projections 59 and towards application area 20 using a minimal amount of pressure or force. For example, a user may push the object with the user's fingers past projections 59 and through opening 52 to contact the object with an adhesive side of label portion 110. In one preferred embodiment of this invention, chute 50 is movable with respect to application area 20. For example, when the user applies pressure to the object to contact the object with the label portion adhesive side, chute 50 alone, or with support 40, may be pushed or moved towards application area 20 until the object contacts the label portion adhesive side.

In one preferred embodiment of this invention, label assembly 100, including label portion 110 and the object adhesively adhered or applied to label portion 110, is removed from apparatus 10 by slidably moving or pulling label assembly 100 from within gap 42. In an alternate preferred embodiment of this invention, a movable element 60 is operatively connected to support 40 for removing the object from within chute 50 after label portion 110 is applied to the object. As the object is removed from chute 50 by activating movable element 60, label portion 110 is transferred from label assembly 100 onto the object. The remaining portion of label assembly 100 is retained within apparatus 10. For example, movable element 60 may comprise a lever or handle that is pivotable to pull the object, including label portion 110 adhesively adhered or applied to the object, from within chute 50, while the remaining portion of label assembly 100 is secured within apparatus 10, to transfer label portion 110 from label assembly 100 onto the object.

Referring generally to FIGS. 4–6, label assembly 100 is of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. Label assembly 100 preferably comprises face sheet 120 and back sheet 150 with a layer of adhesive between. Suitable label assemblies are disclosed in copending, commonly-owned U.S. patent application Ser. No. 10/243,481 having a filing date of 25 Apr. 2003, the disclosure of which is incorporated herein by reference.

Face sheet 120 is preferably but not necessarily constructed of any suitable paper, paper composite, non-metal and/or metal material that can be used as a label. Other suitable materials for constructing label sheet 120 include fabric, plastic, and metal foils. An adhesive coating is applied, in any suitable manner known to those skilled in the art, to one side of face sheet 120. Face sheet 120 preferably has a printable surface on a side opposite the adhesive side. The printable surface on face sheet 120 can be any of a variety of face materials used to make pressure sensitive, or self-adhesive labels. Such face materials may include, but are not limited to, smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Further, various portions of the face materials can be different colors, thereby resulting in different colored parts, such as a carrier portion 140 and/or label portion 110, as described in greater detail below.

As used throughout this specification and/or in the claims, the term "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Prior to assembling, label assembly 100 can be fed into and run through a printer for labeling and/or decorating any portion. Label assembly 100 therefore includes at least one printable side for accepting printing, such as descriptive and/or decorative material.

In one preferred embodiment of this invention, label assembly 100 comprises face sheet 120 having label portion 110 removable with respect to carrier portion 140 of face sheet 120, as shown in FIG. 5. Label portion 110 is preferably pre-cut or shaped into a desired form for application in a desired manner.

Back sheet 150 of label assembly 100 preferably includes first portion 160 that is removable with respect to second portion 170. Back sheet 150 preferably includes one side having a treated surface to facilitate removal of back sheet 150 relative to face sheet 120. Therefore, at least one side of back sheet 150 preferably includes a smooth and/or waxy surface to ease separation from the adhesive side of face sheet 120. The side opposite the treated surface of back sheet 150 may be a printable surface or any other suitable surface. As shown in FIG. 6, first portion 160 of back sheet 150 is preferably generally coextensive with label portion 110 of face sheet 120. Likewise, second portion 170 of back sheet 150 is preferably generally coextensive with carrier portion 140 of face sheet 120.

In one preferred embodiment of this invention, when first portion 160 is removed from label assembly 100, second portion 170 of back sheet 150 is attached to label portion 110 of face sheet 120. Second portion 170 of back sheet 150 may be attached to label portion 110 entirely around a perimeter of label portion 110 or at one or more distinct points of label portion 110. In one preferred embodiment of this invention, back sheet 150 is "attached" to label portion 110 if movement of back sheet 150 results in complementary movement of label portion 110.

As shown in FIG. 5, label portion 110 may be circular, for instance to facilitate application to a CD. First portion 160 is preferably correspondingly circular and has a diameter less than a diameter of label portion 100. Similarly, FIG. 6 shows circular label portion 110 and first portion 160 that is generally circular and generally coextensive with label portion 110 including two or more areas of overlap from back sheet 150 onto label portion 110. The areas of overlap may comprise two or more retainers 175 extending from second portion 170 and adhering to label portion 110.

In one preferred embodiment of this invention, label assembly 100 further includes at least one index tab 165 extending from a periphery of first portion 160. First portion 160 may include at least two index tabs 165, such as shown in FIG. 4. Index tab 165 is preferably shaped in such a manner so as to facilitate peeling away of first portion 160.

In one preferred embodiment of this invention, particularly for use with labels for CDs and DVDs, center hole 135 is preferably positioned in a center area of label portion 110. In addition, at least one index hole 145 may be positioned within carrier portion 140. Index hole 145, as shown in FIGS. 5 and 6, may be positioned directly underneath index tab 165 or in any other appropriate position on label assembly 100 including through back sheet 150 and/or face sheet 120.

In one preferred embodiment of this invention, when first portion 160 is peeled away or otherwise removed from label portion 110, center hole 135 is opened and/or removed from label portion 110. Likewise, when first portion 160, including index tabs 165 is removed from label portion 110 and/or carrier portion 140, index hole 145 is opened and/or removed from label portion 110 and/or carrier portion 140.

Center hole 135, index hole 145 and/or any other cutout segment of face sheet 120 may be separated from a remaining portion of face sheet 120 using an arrangement of cuts. One or more first cuts 162 may extend downwardly into first portion 160, as shown in FIG. 4, and one or more second cuts 172 may extend upwardly into label portion 110, as shown in FIG. 5, resulting in one or more alternating cuts extending in each direction through label assembly 100. As a result, first cut 162 and second cut 172 join a segment, section and/or cutout of label portion 110 and/or carrier portion 140 to the treated (removable) side of first portion 160.

Alternatively, or in addition, and as shown in FIGS. 3–5, center hole 135 may be opened upon removal of first portion 160 using die cut 139 extending partially along a perimeter of center hole 135 through both face sheet 120 and back sheet 150. Die cut 139 is preferably generally arcuate and positioned along a side of center hole 135 that corresponds with a side of first portion 160 that is removed first, as particularly shown in FIG. 6. In one embodiment of die cut 139 having an arcuate shape, the arc preferably extends between approximately 1° and 180° along center hole 135 and more preferably extends between approximately 5° and 90° along the center hole.

As described above, first portion 160 is separable from label assembly 100 across one or more lines of separation 200 that are positioned in back sheet 150 and each extend from a boundary line between first portion 160 and second portion 170 and inward into back sheet 150. As a result of lines of separation 200, first portion 160 is separable from second portion 170.

In one preferred embodiment of this invention, label assembly 100 is used for applying a label portion to a surface of a CD or a DVD, and includes face sheet 120 having a circular label portion 110 that is removable with respect to carrier portion 140 of face sheet 120 and then applied to the CD. Back sheet 150 includes a generally circular first portion 160 removable with respect to second portion 170 of back sheet 150. With the adhesive layer of label portion 110 exposed, a CD may be placed on top of label assembly 100 thereby affixing label portion 110 to the CD surface.

Label portion 110 may be circular to correspond with a diameter of a CD or may be decorative, such as including a fanciful flower or buzzsaw outline for unique applications. The shape of label portion 110 is not limited by the manner in which it is applied according to this invention because label portion 110 remains attached to carrier portion 140 until the object is applied and therefore is not subject to bending, curling, wrinkles and/or other imperfections which a fanciful outline may otherwise include. In other words, when a traditional label is removed from a back sheet and then applied to another object, the traditional label curls as it is removed and then tends to wrinkle or bend as it is applied. In contrast, label assembly 100 according to this invention maintains label portion 110 in a flat and fixed position. Therefore, the object to be labeled may be uniformly applied to the label rather than vice versa.

In one preferred embodiment of this invention, label assembly 100 may include at least one additional label portion, such as additional portion 163, removable from back sheet 150 for use elsewhere in the particular application, for instance, for placement on a jewel case of the CD. Additional portion 163 may be arranged in the same way as label portion 110 or may otherwise be a traditional label that is removed from back sheet 150 for subsequent placement on an object.

In one preferred embodiment of this invention, label portion 110 is transferred from label assembly 100 onto an object, such as a CD. Label assembly 100 is slid or inserted between base 15 and elevated support 40 connected with respect to base 15. For example, label assembly 100 is positioned within gap 42 formed between first surface 16 and elevated support 40, which is connected with respect to first surface 16. For example, elevated support 40 may form a support plate, as shown in FIG. 1, which is mounted or connected to base 15 and is suspended or elevated over at least a portion of first surface 16 to position chute 50 with respect to application area 20. In one preferred embodiment of this invention, stop element 22 limits movement of label assembly 100 within gap 42 as label portion 110 is positioned within application area 20. Further, stop element 22 may further comprise indexing element 24 for indexing label assembly 100 on apparatus 10 before the CD contacts the label portion adhesive side.

Preferably, but not necessarily, apparatus 10 further comprises at least one guide 30, 32 positioned with respect to application area 20 to guide or position label portion 110 within application area 20. For example, label assembly 100 may be positioned between opposing guides 30, 32 connected to, formed on or integrated with base surface 16 to guide label assembly 100 within gap 42 and position label portion 110 in application area 20. Label portion 110 is positioned within application area 20 defined on base surface 16 with an adhesive side of label portion 110 exposed. In one preferred embodiment of this invention, a first portion 160 of label assembly back sheet 150 is removed from label assembly face sheet 120 to expose the label portion adhesive side. Pull tab 165 preferably extends from a periphery of back sheet first portion 160 to facilitate the removal of back sheet first portion 160 from face sheet 120. The label portion adhesive side may be exposed before label assembly 100 is slid within gap 42, or the label portion adhesive side may be exposed after label portion 110 is positioned within application area 20.

Preferably, opposing guide 30, 32 and/or stop element 22 each further comprises lip portion 33, 34, 26, respectively, to maintain contacting relation between label assembly 100 and base surface 16 to prevent the exposed adhesive side from undesirably contacting elevated support 40 as label assembly 100 is slid, inserted and/or positioned within gap 42, particularly if the label portion adhesive side is exposed before label assembly 100 is slid, inserted and/or positioned within gap 42.

The CD is released and/or positioned within chute 50, which is suspended or elevated over application area 20 with the surface of the CD onto which label portion 110 is to be applied facing application area 20. In one preferred embodiment of this invention, the CD is retained within chute 50 by a plurality of projections 59 formed on chute inner surface 56. With the CD retained within chute 50 by projections 59, the CD can be aligned and positioned with label portion 110. With the CD properly positioned within chute 50 and label portion 110 positioned within application area 20 with the adhesive side exposed, chute 50 is moved towards the label portion adhesive side to contact the CD surface with the label portion adhesive side to apply label portion 110 to the CD. Preferably, elevated support 40 is movable with respect to base 15 to move the CD towards label portion 110 to contact the CD with label portion 110. For example, the user may apply a pressure or a force to elevated support 40 to move elevated support 40 and chute 50 toward base 15, thereby contacting the CD surface with label portion 110. The applied pressure or force moves the CD past projections 59 to contact the label portion adhesive side.

The CD is then removed from apparatus 10 and label portion 110 is separated from the remaining label assembly as label portion 110 is transferred from label assembly 100 onto the CD. In one preferred embodiment of this invention, label assembly 110 is removed from apparatus 10 by sliding label assembly 100, including label portion 110 and the CD to which label portion 110 is adhesively connected or applied, from within gap 42. The CD and applied label portion 110 are stripped or removed from label assembly 100 to transfer label portion 110 from label assembly 100 onto the CD.

In an alternate preferred embodiment of this invention, chute 50 maybe movably connected to elevated support 40 and independently movable with respect to base 15. In this alternate preferred embodiment, the user may apply a pressure or a force to chute 50 to move chute 50 with respect to elevated support 40 and towards label portion 110 to contact the CD surface with the label portion adhesive side. After label portion 110 is applied to the CD surface, the CD is removed from chute 50 with applied label portion 110 to transfer label portion 110 from label assembly 100 onto the CD. A remaining portion of label assembly 100, including carrier portion 140, remains on apparatus 10 following the transfer of label portion 110 from label assembly 100 onto the CD. For example, chute 50 is moved in an opposite direction with respect to base 15, i.e., in a direction away from base 15, to transfer label portion 110 onto the CD surface. Chute 50 may be biased towards its initial position using any suitable mechanical biasing element, such as a spring. Alternatively or in addition, a movable element, such as a lever or handle, operatively connected to support 40 may be activated to remove the CD with applied label portion 110 from chute 50. After the CD and applied label portion 110 are removed from chute 50, carrier portion 140 can be removed from within gap 42 by sliding or pulling carrier portion 140 out from within gap 42.

Thus, the invention provides an apparatus and method for transferring a label portion from a label assembly onto an object, wherein the apparatus comprises an elevated support connected with respect to a base surface to form or define a space or gap between the base surface and the elevated support. The label assembly is slid within the gap formed between the base surface and the elevated support, and positioned on the base surface to position the label portion within the application area defined on the base surface with an adhesive side of the label portion exposed. The apparatus further comprises a chute connected to, mounted on or formed by the elevated support, and suspended over the application area. The object is positioned within the chute so that the object can contact the adhesive side of the label portion to apply the label portion to the object. The object is then removed from the apparatus and the label portion is transferred from the label assembly onto the object.

In one preferred embodiment of this invention, the label assembly, including the label portion and the object adhesively connected to the label portion, is slidably removable from within the gap, and the object and label portion are stripped from the label assembly to transfer the label portion from the label assembly onto the object.

In an alternate preferred embodiment of this invention, the object is removed from within the chute with the label portion adhesively connected to the object as the remaining portion of the label assembly remains securely positioned within the apparatus, to transfer the label portion from the label assembly onto the object. The remaining label assembly can then be slidably removed from within the gap formed between the base surface and the elevated support.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for transferring a label portion from a label assembly onto an object comprising:

sliding the label assembly between a base and an elevated support connected with respect to the base;

positioning the label portion within an application area defined on the base with an adhesive side of the label portion exposed;

releasing the object within a chute mounted on the support and elevated over the application area;

contacting the object with the adhesive side of the label portion to apply the label portion to the object; and removing the object from the apparatus.

2. The method of claim 1 further comprising:

limiting movement of the label assembly within a gap between the base and the support as the label portion is positioned within the application area with a stop element.

3. The method of claim 1 further comprising:

positioning the label assembly between opposing guides connected to the base.

4. The method of claim 1 further comprising:

retaining the object within the chute by a plurality of projections formed on an inner surface of the chute.

5. The method of claim 4 further comprising:

aligning the object with the label portion as the object is retained within the chute.

6. The method of claim 5 further comprising:

applying pressure to the object to move the object past the plurality of projections to contact the adhesive side of the label portion.

7. The method of claim 1 further comprising:

moving the chute towards the application area to contact the object with the label portion adhesive side.

8. The method of claim 1 further comprising:

removing the label assembly from the apparatus by sliding the label assembly, including the label portion applied to the object, from within the gap formed between the base surface and the support.

9. The method of claim 8 further comprising:

stripping the object and the applied label portion from the label assembly to transfer the label portion from the label assembly onto the object.

10. The method of claim 1 further comprising:

removing the object from the chute with the applied label portion to transfer the label portion from the label assembly onto the object as a remaining portion of the label assembly is retained within the apparatus.

11. The method of claim 1 further comprising:

activating a movable element operatively connected to the support to remove the object with the label portion applied to the object from the chute.

12. The method of claim 1 further comprising:

applying pressure to the object to apply the label portion to the object.

13. The method of claim 1 further comprising:

separating the label portion from the remaining label assembly as the label portion is transferred from the label assembly onto the object.

14. The method claim 1 further comprising:

indexing the label assembly on the apparatus before the object contacts the label portion adhesive side.

15. A method for transferring a label portion from a label assembly onto an object comprising:

sliding the label assembly between a surface of a base and an elevated support connected to the base;

positioning the label portion within an application area defined on the base surface with an adhesive side of the label portion exposed;

positioning the object within a chute formed on the support and suspended over the application area;

contacting the object with the adhesive side of the label portion to apply the label portion to the object; and sliding the label assembly from the apparatus with the object adhesively connected to the label portion.

16. The method of claim 15 further comprising:

stripping the object and label portion from the label assembly to transfer the label portion from the label assembly onto the object.

17. The method of claim 15 further comprising:

removing a portion of a back sheet of the label assembly from a face sheet of the label assembly to expose the label portion adhesive side.

18. The method of claim 15 further comprising:

removing a portion of a back sheet of the label assembly from a face sheet of the label assembly using a pull tab extending from a periphery of the back sheet portion.

19. The method of claim 15 further comprising:

exposing the label portion adhesive side before the label assembly is slid within the gap formed between the base surface and the support.

20. The method of claim 15 further comprising:

exposing the label portion adhesive side after the label portion is positioned within the application area.

21. A method for transferring a label portion from a label assembly onto an object comprising:

sliding the label assembly between a surface of an apparatus base and a support elevated with respect to the base surface;

positioning the label portion within an application area defined on the base surface with an adhesive side of the label portion exposed;

releasing the object within a chute formed on the support and elevated over the application area;

contacting the object with the adhesive side of the label portion to apply the label portion to the object; and removing the object from within the chute with the label portion applied to the object to transfer the label portion onto the object.

22. The method of claim 21 further comprising:

activating a moving element to remove the object from the chute with the label portion applied to the object.

23. The method of claim 21 further comprising:

retaining a carrier portion of the label assembly on the apparatus following transfer of the label portion from the label assembly onto the object.

24. The method of claim 21 further comprising:

slidably removing the carrier portion from within the gap formed between the base surface and the support.

* * * * *